United States Patent [19]

Ohmi

[11] 4,415,096

[45] Nov. 15, 1983

[54] CONTAINER CLOSURE HAVING AN IMPROVED LINER

[75] Inventor: Hidehiko Ohmi, Hirazuka, Japan

[73] Assignee: Toyo Seikan Kaisha, Ltd., Tokyo, Japan

[21] Appl. No.: 294,018

[22] Filed: Aug. 18, 1981

[30] Foreign Application Priority Data

Sep. 2, 1980 [JP] Japan ..... 55-120687

[51] Int. Cl.[3] ..... B65D 53/00

[52] U.S. Cl. ..... 215/343

[58] Field of Search ..... 215/327, 343, 344, 345

[56] References Cited

U.S. PATENT DOCUMENTS

| | | | |
|---|---|---|---|
| 2,768,762 | 10/1956 | Guinet | 215/343 X |
| 3,257,021 | 6/1966 | Brockett . | |
| 4,089,463 | 5/1978 | Babiol | 215/344 X |
| 4,114,775 | 9/1978 | Shinozaki | 215/343 X |

FOREIGN PATENT DOCUMENTS

| | | |
|---|---|---|
| 62360 | 1/1955 | France . |
| 969103 | 9/1964 | United Kingdom . |
| 1025933 | 4/1966 | United Kingdom . |

*Primary Examiner*—Donald F. Norton

*Attorney, Agent, or Firm*—Pennie & Edmonds

[57] ABSTRACT

A container closure in the form of a metal shell having a plastic liner press-formed onto the inner top surface of the shell. The liner has at least two circular downwardly projecting rims with the radially inner rim having a greater projected height than said radially outer rim.

7 Claims, 10 Drawing Figures

CONTAINER CLOSURE HAVING AN IMPROVED LINER

TECHNICAL FIELD

This invention relates to a container cover, and more accurately, to a container closure comprising a metal shell having an inner circular surface as well as a substantial cylindrical-shaped skirt which depends from the circumference of the circular surface and of a synthetic resin liner which is press-molded to the inner surface of the shell.

BACKGROUND OF THE INVENTION

It is essential that a container closure of the shape described above have a synthetic resin liner which may be positioned on the underside of the shell to obtain a tight seal with a container opening. In Japanese Patent Gazette Item 53-65184 (1978) which is also Japanese Laid Open Patent Application No. 51-13773 which is one of the priority applications of U.S. Pat. No. 4,114,775, a container closure having this shape is disclosed and includes an outer circular projecting rim forming an inner circumference surface that is adhered to the outer circumference surface of the container opening when tightly sealed and a liner press-molded to the inner surface of the metal shell where the liner includes an inner circular projecting rim which has an outer circumferential surface that adheres to the inner circumferential edge of the container opening for the purpose of improving sealing characteristics. A container closure possessing this kind of liner configuration has improved sealing characteristics in comparison to container closures with previously proposed liner configurations as described in the above-mentioned patent gazette item.

However it has been found that a decline in the tight sealing characteristics developes when a fairly large impact is inflicted to a container closure that has the above-mentioned liner configuration.

An improved liner that can maintain tight sealing characteristics even with the infliction of a fairly large impact is disclosed in U.S. application Ser. No. 208,398, filed Nov. 19, 1980, now U.S. Pat. No. 4,379,512, assigned to the same assignee as this application. The liner disclosed has a first circular projecting rim which provides an inner circumferential surface that adheres to the outer circumferential surface of a container opening to seal tightly and has a second circular projecting rim which adheres to the top surface of the container opening and is arranged so as to be positioned opposite the top surface of the opening at the inside of the first circular projecting rim. It is disclosed in the patent that the height of the second circular projecting rim is somewhat less than the height of the first circular projecting rim.

It has now been found, however, that the height of the second circular projecting rim should be greater than the height of the first circular projecting rim in order to increase the anti-impact capability of the closure. Further, it has been found that if the height of the second circular projecting rim is greater than the height of the first circular projecting rim, that any decrease in the tight seal characteristic due to the so-called "doming" phenomenon of the container closure (the phenomenon where the container closure surface changes shape by protruding upward due to the existence of pressure within the container) can be prevented with greater certainty.

It is therefore an object of the invention to provide for a container closure having a liner including at least circular projecting rims where a radially inner rim has a greater height than a radially outer rim in order to increase impact resistance and reduce loss of sealing characteristics due to "doming".

GENERAL DESCRIPTION OF THE INVENTION

Broadly a container closure constructed according to the invention comprises a metal shell having a circular top surface and a cylindrical skirt depending from the periphery of the top surface. A synthetic resin liner is press-formed on the inside top surface of the shell and includes at least a first and second projecting rim on the surface of the liner opposite the shell. The rim which is radially inwardly of the two rims has a height which is greater than that of the radially outward rim.

In addition, the skirt has a so-called "roll-on" format to engage a threaded portion on the edge of the opening whereby the liner will be deformed to adhere and tightly seal with the container. The invention is also explained in terms of a container closure with a format where the skirt of the shell changes shape at the inside along an axis of the radius when the shell adheres to and tightly seals with the container opening. This invention, however, is not limited to a container closure with this type of characteristic format but can also be applied to several kinds of container closures such as a container closure with a typical "roll-on" format without any increase in shape change at the skirt of the shell as well as container closures with the so-called "screw-on" format where a spiral is formed in advance and before the skirt engages or adheres and seals tightly to the opening of a container when tightly sealed.

BEST MODES FOR CARRYING OUT THE INVENTION

Figure 1:
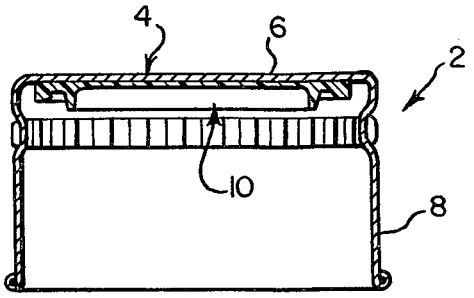
FIG. 1 is a side sectional view of a container closure constructed according to the invention.

Referring to FIG. 1, there is illustrated a container closure 2 comprising a metal shell 4 which has an inner circular surface 6 and a substantial cylindricalshaped skirt 8 that depends from the periphery of the circular surface. A synthetic resin liner 10 is pressmolded to the inner surface 6 of the metal shell 4. The metal shell can be formed from any suitable and relatively pliable metal by standard manufacturing techniques known in the industry, and tin plate, chromed steel, and especially aluminum alloy are convenient for such press-forming. The synthetic resin liner 10 can be formed by press-molding such synthetic polyolefin resins as polyethylene or polyvinyl chloride, etc. based on commonly known techniques (techniques such as disclosed in; U.S. Pat. No. 3,135,019, U.S. Pat. No. 3,212,131 and U.S. Pat. No. 3,278,985.

Figure 2:
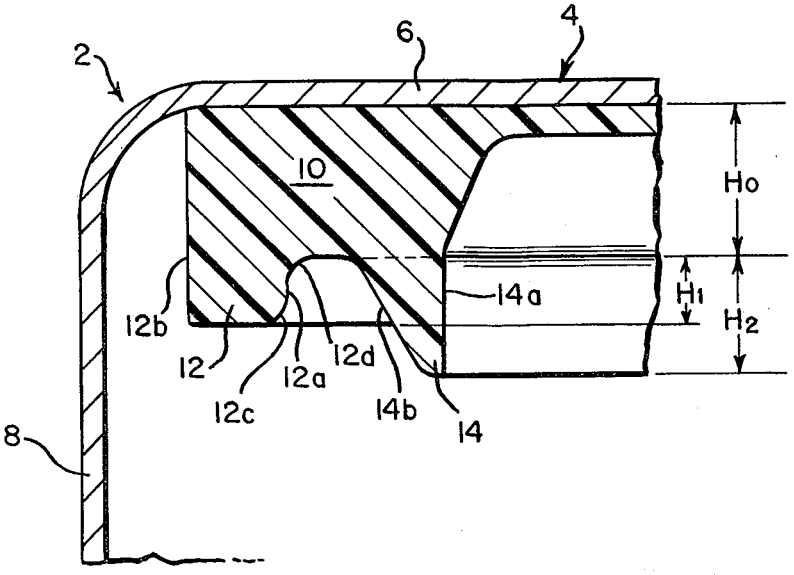
FIG. 2 is an enlarged view of a portion of FIG. 1.
Figure 3:
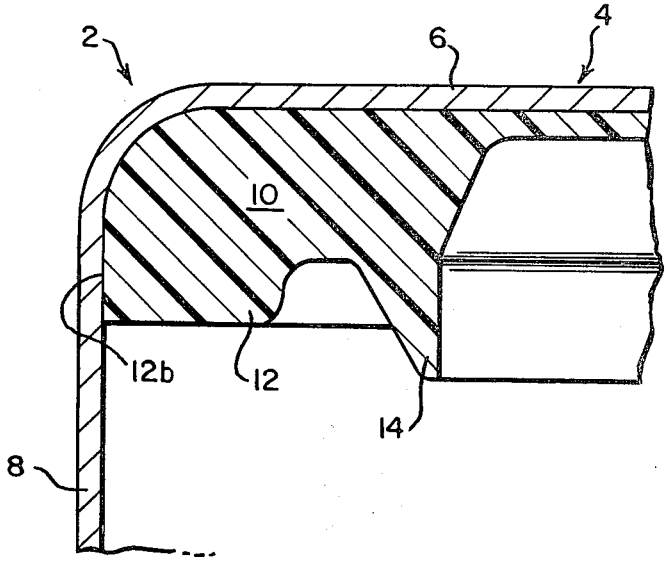
FIG. 3 is a side sectional view of a further embodiment of a container closure constructed according to the invention.
Figure 4:
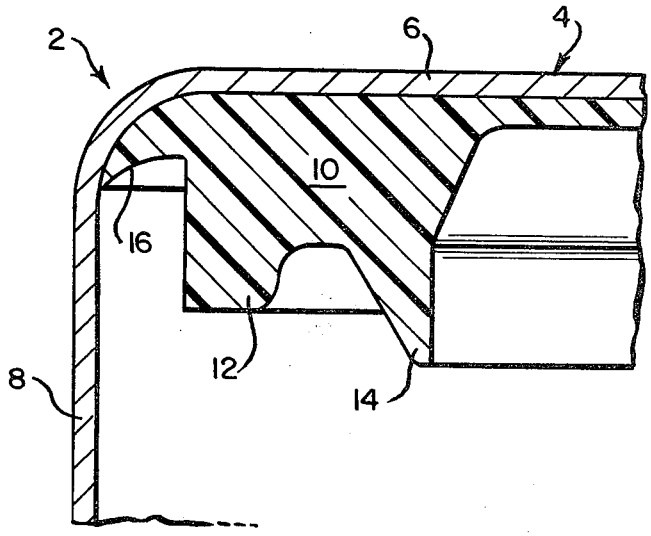
FIG. 4 is a side sectional view of a still further embodiment of a container closure constructed according to the invention.

The liner 10 illustrated in FIG. 2 with the improvements according to this invention has two circular projecting rims 12 and 14. The first circular projecting rim 12 is positioned radially outwardly of the second rim 14 and has an inner circumferential surface 12*a* that is adapted to seal with the outer circumferential surface of a container opening when the container closure is installed to tightly seal to the opening of the container. In terms of such points as required amount of synthetic resin material, sealing characteristics, etc., the first circular projecting rim 12 is designed to substantially protrude in a perpendicular direction from the surface 6 of the shell to provide a radial space between the rim 12 and the inner circumferential surface of the skirt 8. Both the inner circumferential surface 12*a* and the outer circumferential surface 12*b* substantially protrude in a perpendicular direction from the surface 6 of the shell. Therefore the tip 12*c* of the inner circumferential surface will ideally incline outwardly along an axis of the radius to facilitate fitting into the container opening and preferably the tip 12*c* inclines outwardly along an axis of the radius to produce a curved surface with a particularly suitable curvature. The base 12*d* of the inner circumferential surface also forms a thick footing portion that inclines along an axis of the radius for the purposes of strengthening the first circular projecting rim 12 and facilitating press-molding. On the other hand, if there is any concern about the effects of a fairly large impact on the shell 4 shoulder (that is to say, on the area between the surface 6 and the skirt 8), the inside surface of the skirt 8 is caused to contact the outer circumferential surface 12*b* of the first circular projecting rim, as shown in FIG. 3, for the purpose of increasing resistance against impact, or projecting tabs 16 can be formed in the radial space between the first circular projecting rim 12 and the skirt 8 as shown in FIG. 4.

The second circular projecting rim 14 is positioned radially inwardly of the projecting rim 12 and is adapted to be located against the top surface of the opening of the container when tightly sealed. As will be explained, it is important that it is made to adhere to the top surface of the container opening when the container closure 2 is installed to tightly seal to the opening of the container. It is also necessary that the second circular projecting rim 14 of the container 2 constructed according to this invention protrude further downwardly than the tip of the first circular projecting rim 12 and that the height of protrusion $H_2$ of the second circular projecting rim 14 be greater than the height of protrusion $H_1$ of the first circular projecting rim 12. The second circular projecting rim 14 may have, for example, a form such as is shown in FIG. 2, taking into consideration such major factors as the strength of adherence to the top surface of the container opening, which exercises an effect on the tight sealing characteristics, facilitation of press-molding, etc. Thus preferably the rim 14 has a form where:

(a) its thickness gradually decreases toward the edge of protrusion; and (b) when this condition (a) is fulfilled, that the outer circumferential surface 14*b* inclines inwardly along an axis of the radius toward the edge of protrusion in contrast to the inner circumferential surface 14*a* which is essentially perpendicular to the shell 4 surface, bending inwardly along an axis of the radius to adhere to the top surface of the container opening.

Figure 5:
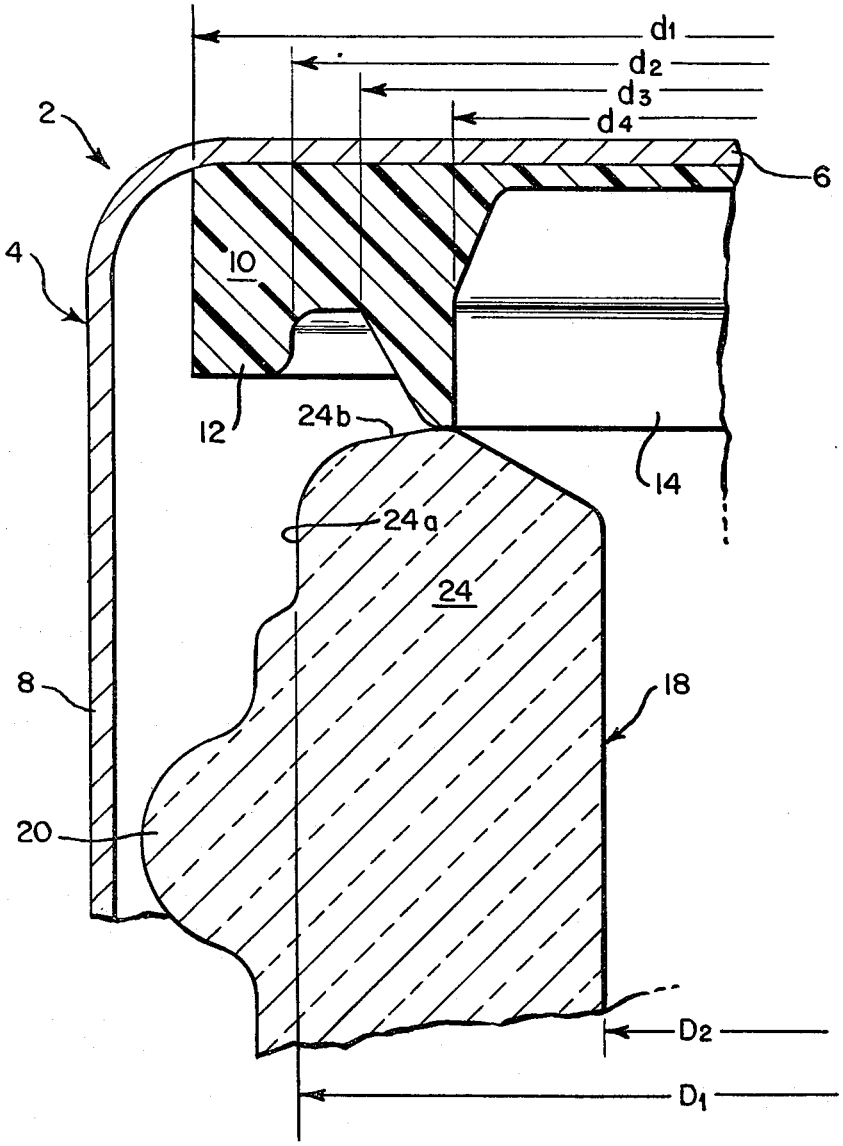
FIG. 5 is a side sectional view of the closure of FIG. 2 being applied to a container.

The dimensions of each part of the liner 10 configuration mentioned above can be correctly established with standards of measurement for each portion of a container opening when tightly sealed, as is shown in Table 1 which indicates ideal examples of respective line 10 sections in terms of an inside diameter $D_2$ and an outside diameter $D_1$ of a container opening with reference to FIG. 5.

TABLE 1

| | Desired range | Particularly desired range |
|---|---|---|
| First circular projecting rim 12 outside diameter $d_1$ | 1.03 $D_1$ to 1.10 $D_1$ | 1.05 $D_1$ to 1.08 $D_1$ |
| First circular projecting rim 12 inside diameter $d_2$ | 0.96 $D_1$ to 1.02 $D_1$ | 0.98 $D_1$ to 1.01 $D_1$ |
| Second circular projecting rim 14 outside diameter $d_3$ | 0.90 $D_1$ to 0.97 $D_1$ | 0.92 $D_1$ to 0.94 $D_1$ |
| Second circular projecting rim 14 inside diameter $d_4$ | 1.02 $D_2$ to 1.15 $D_2$ | 1.05 $D_2$ to 1.12 $D_2$ |
| First circular projecting rim 12 height of protrusion $H_1$ | 0.4 mm to 1.0 mm | 0.6 mm to 0.8 mm |
| Second circular projecting rim 14 height of protrusion $H_2$ | 0.5 mm to 1.6 mm | 0.85 to 1.2 mm |
| Thickness of base between first circular projecting rim 12 and second circular projecting rim 14 $H_0$ | 0.4 mm to 1.8 mm | 0.5 mm to 1.2 mm |

The sealing engagement of the first circular projecting rim 12 and the second circular projecting rim 14 of the liner 10 is explained with reference to FIGS. 5 and 6 where the liner engages a container opening 18.

As is well known in the industry, in attaching the container closure 2 to seal tightly against the container opening 18, the closure 2 is pressed against the opening 18 which increases pressure on the outer periphery or shoulder of the shell surface. In terms of the following circumstances, the shoulder of the shell changes shape inwardly along an axis of the radius when the spiral 22 is rolled onto the skirt 8 by forcing the skirt against the spiral 20 on the outer circumferential surface of the container opening 18. Therefore the container closure 2 is firmly sealed to the opening 18 by fitting the spiral 20 of the container opening 18 to the spiral 22 formed on the skirt 8.

Figure 6:
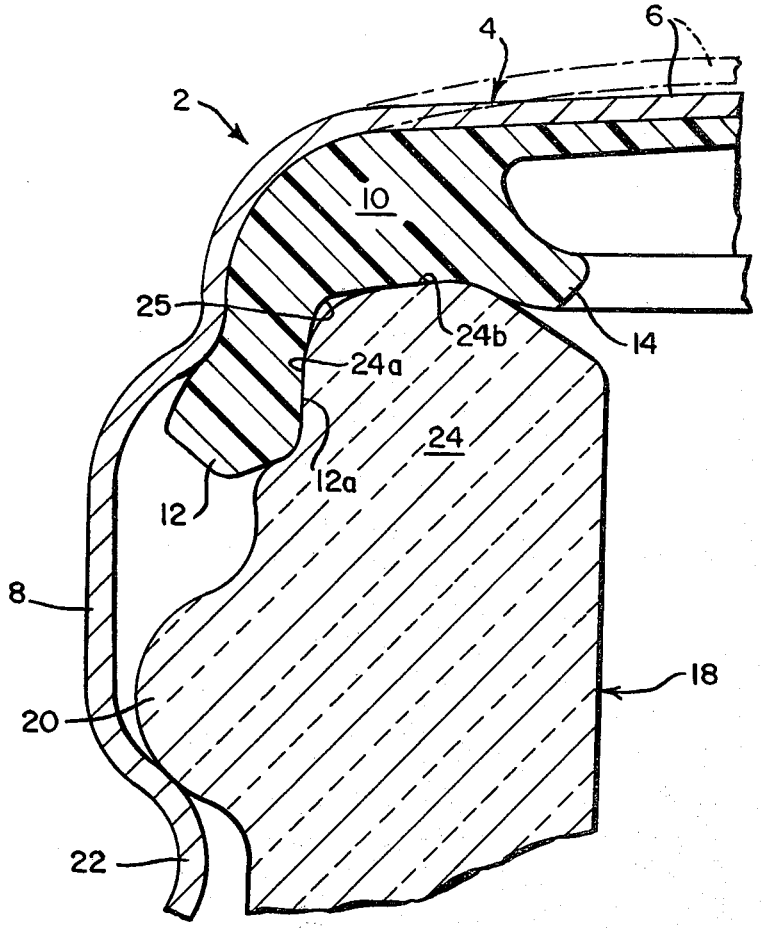
FIG. 6 is a side sectional view of the closure of FIG. 2 in sealing engagement with a container.

The first projecting rim 12 of the liner 10 tightly seals the container closure 2 to the container opening 18 by the closure 2 pressing the liner downwardly as is shown in FIGS. 5 and 6 as well as the shoulder of the shell 4 changing shape radially inwardly along an axis of the radius shown in FIG. 6 which presses the inner circumferential surface 12*a* to the edge of the container opening 18, that is to say, to the outer circumferential surface 24*a* of the container opening edge 24. The second circular projecting rim 14 of the liner 10 contacts the upwardly facing or top surface 24*b* of the container opening edge 24 due to the container closure 2 pressing downwardly as in FIGS. 5 and 6. Based on this circumstance and as shown in FIG. 6, the second circular projecting rim 14 of the liner 10 bends elastically inwardly along an axis of the radius and adheres to the upwardly facing or top surface 24*b* of the container opening 24. The container opening 18 is then tightly sealed due to the inner circumferential surface 12*a* of the first circular projecting rim 12 engagng or adhering to the outer circumferential surface 24*a* of the container opening edge 24 along with the second circular projecting rim 14 adhering to the top surface 24*b* of the container opening 24.

It is an advantage if some gaps 25 exist between the liner 10 and the container opening edge 24, such as at the engagement or adherence region between the inner circumferential surface 12*a* of the first circular projecting rim 12 and the outer circumferential surface 24*a* of the container opening edge 24, and at the adherence region between the upwardly facing or top surface 24*b* of the container opening edge 24 and the second circular projecting rim 14, as is shown in FIG. 5. When an impact occurs at the shoulder of the shell 4, contraction of the gap allows the liner 10 to elastically change shape to sufficiently absorb the impact, thus effectively preventing the growth of cracks, etc. in the liner 10 due to this type of impact.

In the example of the container closure disclosed in the aforementioned U.S. patent application Ser. No. 208,398 the height $H_2$ of the second circular projecting rim 14 is smaller than the height $H_1$ of the first circular projecting rim 12. For this reason, in comparing the container closure 2 constructed according to the invention with those of the United States application, the adherence pressure of the inner circumferential surface 12*a* of the first circular projecting rim 12 and the outer circumferential surface 24*a* of the container opening edge 24 undergoes a relative decrease but the adherence pressure of the second circular projecting rim 14 and the upwardly facing or top surface 24*b* of the container opening edge 24 undergoes a relative increase. The anti-impact capability of the tight sealing characteristics increases based on this construction as is apparent from the impact testing which will subsequently be explained. Therefore, any decline in the tight sealing characteristics due to the so-called "doming" in the phenomenon of the container closure 2 can be reduced.

For example, when the substance in a container is a carbonated drink, the surface 4 of the container closure 2 changes shape by protruding upwardly due to pressure which develops inside the container, as is shown by the exaggerated dotted projection at the top of FIG. 6. Here there may be some concern that the tight sealing characteristics will be damaged if the adherence pressure decreases between the second circular projecting rim 14 and the top surface 24*b* of the container opening edge 24, but in terms of a container closure constructed according to this invention, since the adherence pressure between the second circular projecting rim 14 and the top surface 24*b* of the container opening edge 24 undergoes a relative increase, any concern about damage due to the tight sealing characteristics (even when the surface 4 of the container cover 2 changes shaped as described above) can be avoided.

Figure 7:
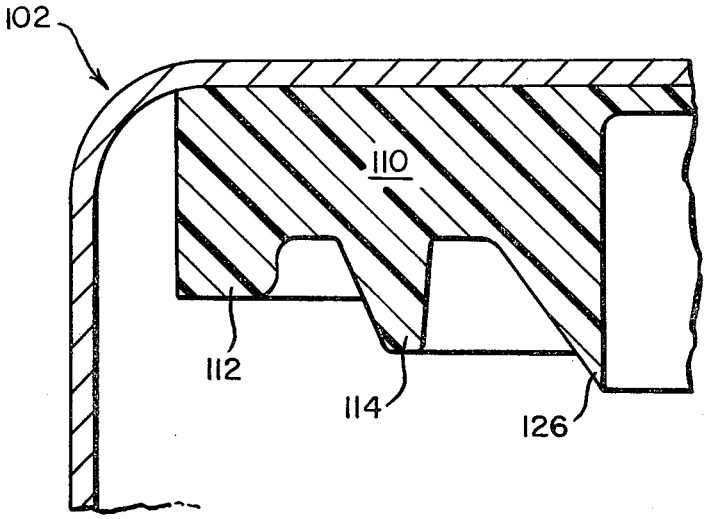
FIG. 7 is a side sectional view of a further embodiment of a closure constructed according to the invention.

Referring to FIG. 7, there is disclosed a further embodiment of a liner having a third projecting rim. As shown the liner 110 has a first projecting rim 112 and a second projecting rim 114 which are similar to rims 10 and 12 of the embodiment of FIG. 2. The liner also includes a third circular projecting rim 126 positioned on the inside of the second circular projecting rim 114. This third circular projecting rim 126 is equipped with an outer circumferential surface 126*a* positioned opposite from the inner circumferential surface 124*c* of the container opening edge 124 and to the inner circumference edge 124*d* of the top surface of the container opening.

Figure 8:
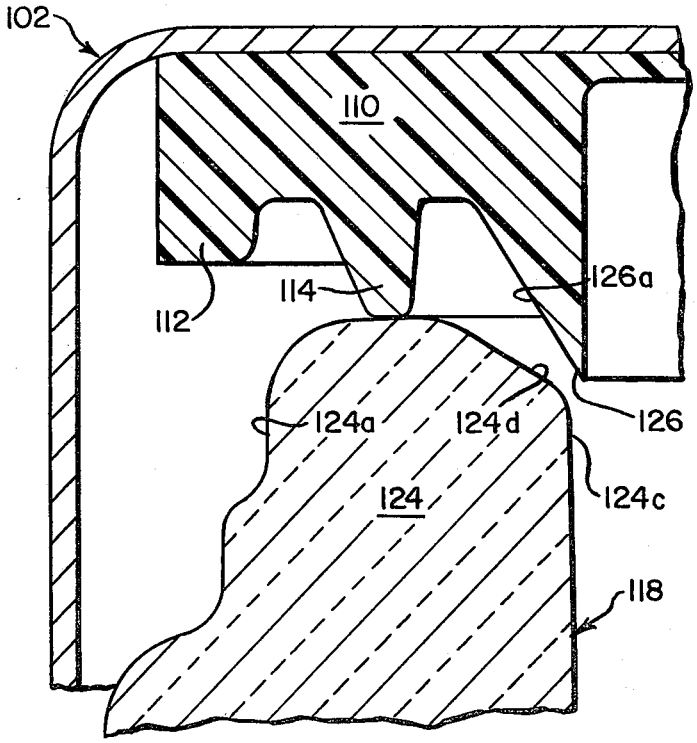
FIG. 8 is a side sectional view of the closure of FIG. 7 being applied to a container.

When a container closure 102 having the liner 110 is pressed downwardly to cover and fit against the container opening 118 as shown in FIG. 8, the outer circumferential surface 126*a* of the third circular projecting rim 126 makes contact with the inner circumferential surface 124*c* of the container opening edge 124, or, the inner circumference edge 124*d*. Because of this arrangement, the container cover 102 is guided into the required position for attachment to the container opening 118. In this case there is little possibility of so-called "diagonal exposure" (an oblique air leak between cover and container edge caused by liner compression imperfection), surface cracking or poor installation due to excessive squeezing of the line on the container opening.

Figure 9:
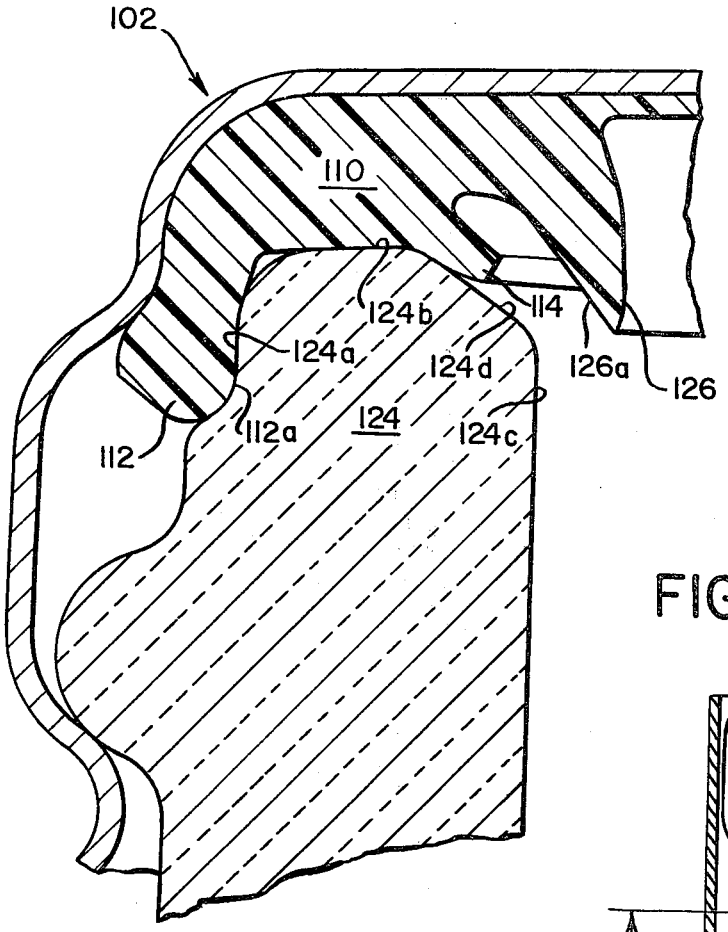
FIG. 9 is a side sectional view of the closure of FIG. 7 in sealing engagement with a closure; and, FIG. 10 is a diagrammatic view of test apparatus for testing impact forces on a closure sealed to a container.

If the container closure 102 is attached and tightly sealed for the required pressure to be sufficiently exerted against the container opening 118, the third circular projecting rim 126 can elastically change shape as shown in FIG. 9 and separate from the container opening 124. Of course, if the container closure 102 is attached and seals tightly on the container opening 118 improperly, the outside circumferential surface 126*a* of the third circular projecting rim 126 may adhere with the inner circumference surface 124*c* of the container opening 124 and to the inner circumference edge 124*d* of the top surface of the container opening. But a portion of the contact or adherence pressure between the container opening 124 and this type of liner 110 carries the adherence of the outer circumferential surface 126*a* of the third circular projecting rim 126 with the inner circumference surface 124*c* of the container opening 124 and with the inner circumference edge 124*d* of the top surface of the container opening. A decrease of this adherence pressure between surfaces 124*c* and *d* and 126*a* as may result from impact forces can occur only if the adherence pressure between the inner circumferential surface 112*a* of the first circular projecting rim 112 and the outer circumferential surface 124*a* of the container opening 124 as well as of the adherence pressure between the second circular projecting rim 114 and the top surface 124*b* of the container opening 124 increases. For this reason, it has been found that there is only a slight decrease in seal capability when a container having such a liner is subjected to an impact.

EXAMPLE AND COMPARATIVE EXAMPLES

An 0.25 mm thick aluminum-base alloy plate was painted with a vinyl-related protective lacquer and printed on one side, while the other side was painted with an epoxy paint containing polyethylene oxide. This metal sheet was then submitted to a press operation where the side painted with the epoxy paint containing polyethylene oxide became the underside, and the sheet was pressed into the metal shell configuration as indicated in FIG. 1. Next, a high pressure polyethylene (0.92 density; 4.0 melt index) was melted at 220° C. and introduced to the underside of the metal shell which has been heated to approximately 180° C. and was then press-molded into a liner having a shape indicated in FIGS. 1 and 2. The respective dimensions of the liner sections were as follows:

| | |
|---|---|
| First circular projecting rim outside diameter $d_1$ | 26.0 mm |
| First circular projecting rim inside diameter $d_2$ | 25.0 mm |
| Second circular projecting rim outside diameter $d_3$ | 22.4 mm |
| Second circular projecting rim inside diameter $d_4$ | 21.5 mm |
| First circular projecting rim height $H_1$ | 0.8 mm |
| Second circular projecting rim height $H_2$ | 1.1 mm |
| Thickness of base between first circular projecting rim and second circular projecting rim $H_0$ | 0.55 mm |

For purposes of comparison, a container closure was produced identical to the above-described Example of this invention where the liner configuration excluded those points indicated in FIG. 4 of the aforementioned Japanese Patent Early Disclosure Report Item 53-65184.

Also for purposes of comparison, a liner with the configuration as indicated in FIG. 2 of the aforementioned U.S. application Ser. No. 208,398 was produced in a container closure identical to the above-described example of this invention, but excluding the following points:

| | |
|---|---|
| First circular projecting rim height $H_1$ | 1.1 mm |
| Second circular projecting rim height $H_2$ | 0.8 mm |

Next, container closures from the Example and Comparative Examples 1 and 2 were applied to container openings with an outside diameter $D_1$ of 24.1 mm and an inside diameter $D_2$ of 19.3 mm and subjected to the following impact testing.

Gas volume after attaching and tightly sealing filled 120 ml in the containers with a 120 ml application of sulphuric acid and sodium bicarbonate to 4 vol. (1 vol. gas volume refers to a 1 cc quantity of carbonic acid gas dissolved in 1 cc of water at 15.5° C. below 1 atmospheric pressure), and when the sample container closures were attached and sealed tightly these were then positioned upright for a one day period at a constant room temperature of 40° C.

Figure 10:
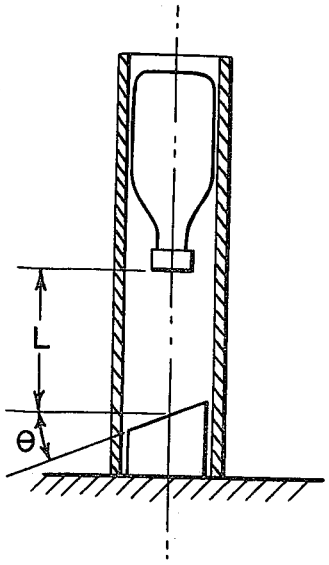

Next, as shown in FIG. 10, each container was perpendicularly inverted within a tube and dropped a distance from the container opening where $l=300$ mm and $=400$ mm. These containers were dropped naturally against a chunk of steel with a 10° incline on its top surface which was positioned at the bottom of the tube, and in this way impact was administered to each of the sample container closures. Then the containers were positioned upright for a one week period at room temperature. When the pressure inside the containers was subsequently measured, any leakage which developed was minimal when the initial pressure of 4 vol. dropped below 3.7 vol.

50 samples of each of the container closures in the Examples and Comparative Examples 1 and 2 were subjected to testing in the above-described manner, and the number of units where leakage did occur is shown in the following table, Table 2:

TABLE 2

| Drop distance | Comparative Example 1 | Comparative Example 2 | Example |
|---|---|---|---|
| 300 mm | 6 units | 4 units | 0 units |
| 400 mm | 43 units | 6 units | 1 unit |

I claim:

1. A container closure for a container having an upwardly facing annular surface forming an opening therein having an outer opening diameter and an inner opening diameter, said closure including a metal shell having a circular top surface and a substantially cylindrical skirt depending from the peripheral edge of the top surface, and a synthetic resin liner press-formed on the inside top surface of the shell; the improvement comprising in that said liner has at least first and second circular projecting rims on the surface thereof opposite said inside top surface of the shell and where the second rim has an inner end second rim diameter and an outer second rim diameter, in that the first rim is positioned radially outwardly of the second rim and has an inner circumferential surface adapted to engage an outer circumferential surface of a container when said closure is sealed to said container, in that said second rim has a height greater than a height of said first rim, in that said second inner rim diameter is greater than said inner opening diameter, and in that said second rim is adapted to engage the upwardly facing surface of said container during initial application of said liner to said container and when sealed to said container.

2. A container closure according to claim 1 further characterized in that the height of said first rim is between 0.4 mm and 1.0 mm and the height of said second rim is between 0.5 mm and 1.6 mm.

3. A container closure according to claim 2 further characterized in that the height of said first rim is between 0.6 mm and 0.8 mm and the height of said second rim is between 0.85 mm and 1.2 mm.

4. A container closure according to claim 1 further characterized in that the thickness of the second rim in a radial direction progressively decreases in a direction away from the inside top surface of the shell.

5. A container closure according to claim 4 further characterized in that the outer circumferential surface of said second rim is inclined towards the edge of the first rim and is adapted to engage said upwardly facing surface of the container.

6. A container closure according to claim 1 further characterized in having a third circular projecting rim on the surface of the liner opposite said inside top surface of the shell positioned radially inwardly of the second rim and having an outer circumferential surface thereof adapted to be opposite an inner circumferential surface of the container.

7. A container closure according to claim 1 further characterized in that said skirt is adapted to have a spiral formed on its outer circumferential surface to create a roll-on format when said closure is sealed to a container and to deform said liner.

* * * * *